US006213318B1

(12) United States Patent
Walker

(10) Patent No.: US 6,213,318 B1
(45) Date of Patent: Apr. 10, 2001

(54) ROTATABLE CONNECTION SYSTEM FOR CRANE BOOM SECTIONS

(75) Inventor: Robert J. Walker, Manitowoc, WI (US)

(73) Assignee: Manitowoc Crane Group, Inc., Reno, NV (US)

( * ) Notice: Subject to any disclaimer, the term of this patent is extended or adjusted under 35 U.S.C. 154(b) by 0 days.

(21) Appl. No.: 09/259,223

(22) Filed: Mar. 1, 1999

(51) Int. Cl.[7] ..... B66C 23/70
(52) U.S. Cl. ..... 212/177; 403/157; 52/726.2
(58) Field of Search ..... 212/177, 292; 403/157, 161, 287, 353; 52/726.1, 726.2, 726.3, 726.4, 726.5, 651.01, 651.02, 651.03, 651.05, 651.07

(56) References Cited

U.S. PATENT DOCUMENTS

| | | | | |
|---|---|---|---|---|
| 534,507 | | 2/1895 | Hoagland et al. . | |
| 608,000 | | 7/1898 | Leatherman et al. . | |
| 1,558,184 | | 10/1925 | Kluender . | |
| 1,807,782 | | 6/1931 | Fuchs . | |
| 1,868,508 | | 7/1932 | Stewart . | |
| 1,941,952 | | 1/1934 | Nickles . | |
| 2,115,194 | | 4/1938 | Burton . | |
| 2,368,290 | | 1/1945 | Donald . | |
| 2,396,747 | | 3/1946 | Parrott . | |
| 2,446,410 | | 8/1948 | Couse . | |
| 2,489,274 | | 11/1949 | Donald . | |
| 2,549,110 | | 4/1951 | Michael . | |
| 2,649,210 | | 8/1953 | Marchese . | |
| 2,809,756 | | 10/1957 | Bannister . | |
| 2,975,910 | | 3/1961 | Conrad . | |
| 3,080,068 | | 3/1963 | Felkner . | |
| 3,085,695 | | 4/1963 | Miller . | |
| 3,250,401 | * | 5/1966 | Davidson | 212/64 |
| 3,323,660 | | 6/1967 | Allin, Sr. . | |
| 3,430,778 | * | 3/1969 | Brown | 212/300 |
| 3,511,388 | | 5/1970 | Markwardt . | |

(List continued on next page.)

FOREIGN PATENT DOCUMENTS

| | | |
|---|---|---|
| 465807 | 1/1969 | (CH) . |
| 585613 | 3/1977 | (CH) . |
| 74 333 | 7/1970 | (DE) . |
| 24 21 456 A1 | 11/1975 | (DE) . |
| 30 00 427 A1 | 10/1980 | (DE) . |
| 33 02 516 C2 | 3/1985 | (DE) . |
| 37 06 301 C1 | 10/1987 | (DE) . |
| 38 42 726 A1 | 6/1990 | (DE) . |
| 0 376 417 | 7/1990 | (EP) . |
| 0 533 323 | 3/1993 | (EP) . |

(List continued on next page.)

*Primary Examiner*—Thomas J. Brahan
(74) *Attorney, Agent, or Firm*—Steven P. Shurtz; Brinks Hofer Gilson & Lione

(57) ABSTRACT

A crane has a boom with a rotatable boom section connection system. The crane has an upper works rotatably mounted on a lower works, the upper works including a load hoist winch. The boom comprises at least a first and second boom section each with a longitudinal axis and a first and second end, the second end of the first section being coupled to the first end of the second section. At least one male connector on the second end of the first section is coupled to a female connector on the first end of the second section. The male connector comprises a base and a protrusion, the base and protrusion each have an extension in a direction generally perpendicular to the longitudinal axis of the first boom section. The extensions and protrusion define a socket. The female connector comprises two protrusions spaced apart at a distance such that the protrusion of the male connector fits between the two protrusions. The female connector further comprises a coupler connected to at least one of the protrusions that extends toward the other protrusion. The coupler fits within the socket of the male connector. A retainer connected between the extensions of the male connector prevents the male and female connectors from uncoupling.

24 Claims, 4 Drawing Sheets

U.S. PATENT DOCUMENTS

| | | | | |
|---|---|---|---|---|
| 3,877,192 | * | 4/1975 | Metailler | 52/638 |
| 4,111,217 | | 9/1978 | Victor . | |
| 4,148,531 | | 4/1979 | Hornagold . | |
| 4,258,940 | | 3/1981 | Fudge . | |
| 4,316,548 | | 2/1982 | Helm et al. . | |
| 4,358,021 | | 11/1982 | Helm et al. . | |
| 4,491,229 | | 1/1985 | Behrendt et al. . | |
| 4,496,262 | | 1/1985 | Sangster . | |
| 4,601,402 | | 7/1986 | Helm et al. . | |
| 4,711,358 | | 12/1987 | Konishi . | |
| 4,712,697 | | 12/1987 | McGowan . | |
| 5,082,128 | | 1/1992 | Franzen et al. . | |
| 5,199,586 | * | 4/1993 | Pech et al. | 212/177 |

FOREIGN PATENT DOCUMENTS

| | | |
|---|---|---|
| 1250050 | 10/1960 | (FR) . |
| 1547958 | 10/1968 | (FR) . |
| 2146899 | 3/1973 | (FR) . |
| 1193544 | 6/1970 | (GB) . |
| 1478648 | 7/1977 | (GB) . |
| 90416 | 3/1959 | (NL) . |
| 542713 | 2/1977 | (RU) . |
| WO 81/02036 | 7/1981 | (WO) . |

* cited by examiner

ROTATABLE CONNECTION SYSTEM FOR CRANE BOOM SECTIONS

BACKGROUND OF THE INVENTION

The present invention relates to lift cranes, and more particularly to rotatable connection systems for sectional boom members for cranes and the like.

Large capacity lift cranes typically have elongate load supporting boom structures comprised of sectional boom members secured in end-to-end abutting relationship. Predominantly, each of the sectional boom members is made of a plurality of generally disposed lacing or lattice elements. The terminal end portions of each chord are generally provided with connectors of one form or another to secure abutting boom segments together and to carry compressive loads between abutting chords. Typical connectors comprise male and female lugs secured by a pin carrying compressive loads in double shear.

An example 220 foot boom may be made of a 40 foot boom butt pivotally mounted to the crane upper works, a 30 foot boom top equipped with sheaves and rigging for lifting and supporting loads, with five sectional boom members in between: one 10 feet in length, one 20 feet in length and three 40 feet in length. Such an example boom has six boom section connections. Typically each section has four chords, and hence four connectors, making a total of 24 connectors that must be aligned and pinned to assemble the boom.

Large capacity cranes require very large boom cross sections. As a result, even when the boom segments are laying flat on the ground, the pin connectors between the top chords are typically eight feet or higher off the ground. The rigging personnel must either move a step ladder to each pin location or stand and walk along the top of the boom to reach the top connectors.

A 40 foot long sectional boom member may weight over 5,000 lbs. Thus, an assist crane is required to lift the boom member. One rigger usually then holds the suspended boom section in general alignment while a second rigger uses a large hammer (10 or 15 lbs.) to manually drive the pin, which typically has a long taper, into position. In the prior art, the pins connecting the boom sections are generally used to carry the compressive loads between chords. As a result, the pins have a tight fit, further increasing the difficulty in assembling the boom. As such, it may take three men (a crane operator and two riggers) four or more hours to assemble the example 220 foot boom. Where the crane is moved frequently, the costs to assemble and disassemble the boom may exceed the cost to lift and position the load for which the crane is used.

Efforts have been made to design sectional boom members with quick-connect systems. For example, U.S. Pat. No. 3,511,388 discloses a pin connection system for boom structures having tubular chord members. Tapered male lug members are disclosed for insertion, presumably with some rapidity, into female sockets. The lugs are then held together by a pin. Compressive loads are carried by machined surfaces on the perimeter of the lugs, slightly larger in width than thickness of the walls of the tubular members.

U.S. Pat. No. 5,082,128 discloses a quick-connect system where the connectors on the top chords have hook-like male lugs and female lugs with spaced members capturing a horizontal pin between them. FIGS. 10*a*–10*c* show how the hook-shaped member can be fit in place while the boom sections are not parallel, with a rotary motion (about the axis of the pins) bringing the boom sections into parallel alignment and mating up bearing surfaces on the end of each male lug with the inner face of each female lug. The horizontal neutral axis of the top chords (which appear to be tubular in cross-section) intersect the centerline of the pin, but does not intersect the compressive load bearing surface, nor is the compressive load bearing surface symmetrical about the horizontal neutral axis.

It would be preferable if compressive load bearing surfaces on connectors were symmetrical about the horizontal and vertical neutral axes of the chords to which they were attached. This would allow compressive loads to be transmitted through the connectors without creating bending moments in the chords. Also, chords having a right angle cross-section are frequently used on boom sections, and quick-connect systems for such chords would be useful.

U.S. Pat. No. 5,199,586 discloses quick-connect sectional boom members that have compressive load bearing surfaces that are not only symmetrical about the vertical and horizontal neutral axes of the chords to which they are attached, but are intersected by a line that is formed by the intersection of these neutral axes.

While the design of the connector of FIGS. 16–18 of the '586 patent have met with commercial success, and allow quick boom assembly when the boom is being constructed in a horizontal fashion, there are times when boom construction would be better carried out in a vertical fashion. For example, when there are job site space constraints, it is not always possible to construct a long main boom and a luffing jib boom on the ground in a layout position. Under these conditions, it is desirable to construct the main boom and just the luffing jib boom butt and luffing jib struts. These components are then boomed up until the luffing jib boom butt hangs vertical. It would be desirable if the next section of luffing jib boom could be brought in and connected while the connection points are as close to the ground as possible. To achieve this, the next section of boom should be oriented horizontally, and the top chord connection made. To do this, it is necessary to have a connection system that will then allow the boom section to rotate 90° about the top chord section while the luffing jib is further raised and the new section of boom is allowed to swing under the luffing jib boom butt into vertical alignment. Thus, an easy, quick-connect system for boom sections that allows for top chord connections that can rotate through 90° would be a great improvement.

SUMMARY OF THE INVENTION

A rotatable connection system for boom sections has been invented. With the invention, boom sections can be added to a boom being constructed in either a horizontal layout configuration or in a vertical configuration, such as adding a boom section onto a hanging luffing jib boom butt.

In a first aspect, the invention is a crane having a boom with a rotatable boom section connection system, the crane having an upper works rotatably mounted on a lower works, the upper works including a load hoist winch, the boom comprising at least a first and second boom section each with a longitudinal axis and a first and second end, the second end of the first section being coupled to the first end of the second section; at least one male connector on the second end of the first section coupled to a female connector on the first end of the second section; the male connector comprising a base and a protrusion, the base and protrusion each having an extension in a direction generally perpendicular to the longitudinal axis of said first boom section, the extensions and protrusion defining a socket; the female connector comprising two protrusions spaced apart at a distance such that the protrusion of the male connector fits between the two protrusions, the female connector further comprising a coupler connected to at least one of the protrusions and extending toward the other protrusion and fitting within the socket of the male connector; and a retainer connected between the extensions of the male connector preventing the male and female connectors from uncoupling.

In a second aspect, the invention is a sectional boom member with a rotatable connection system comprising a boom section having a longitudinal axis, a first end and a second end, and each end having at least three connectors, the at least three connectors of said first end designed to mate with three connectors of a second end of an identical boom section; a first of said at least three connectors on said second end comprising a male connector having a base and a protrusion, and shoulders on the base on at least two sides of said protrusion, the protrusion and base each having an extension in a direction generally perpendicular to the longitudinal axis, the extensions cooperating with the protrusion to define a socket, each of said extensions having an aperture therethrough, the apertures being in line with one another along a line generally parallel to the longitudinal axis; a first of said at least three connectors on said first end comprising a female connector having two protrusions spaced apart at a distance greater than the width of the protrusion on the male connector and a coupling pin spanning between the female protrusions, the coupling pin having a size and being shaped to fit within the socket of the male connector; a retaining pin fitting through the aligned apertures of the male connector for retaining a coupling pin of a female connector of an identical boom section within the socket, thereby preventing the male and female connectors from becoming uncoupled; and the ends of the protrusion on the female connectors having abutment surfaces that are shaped to contact the shoulders of a mating male connector of an identical boom section to transfer compressive loads between the boom sections.

With the invention, a horizontally orientated boom section can be added to a hanging boom. The coupler of the female connection is placed in the socket of the male connector and the retainer is put in place to keep the male and female connectors coupled. The assembly is then boomed up, the weight of the new section being carried by the coupler. The new section is free to rotate until it also is hanging nearly vertically. The section is then swung into an aligned position and lower connector pins can be inserted to secure the bottom connectors. This method of adding sections and booming up is continued until the desired luffing jib boom length is assembled.

These and other advantages of the invention, as well as the invention itself, will best be understood in view of the drawings, a brief description of which is as follows.

DETAILED DESCRIPTION OF THE DRAWINGS AND PREFERRED EMBODIMENTS OF THE INVENTION

For ease of reference, designation of "top, "bottom," "horizontal" and "vertical" are used herein and in the claims to refer to portions of a sectional boom in a position in which it would typically be assembled on or near the surface of the ground. These designations still apply although the boom may raised to different angles, including a vertical position.

Figure 1:
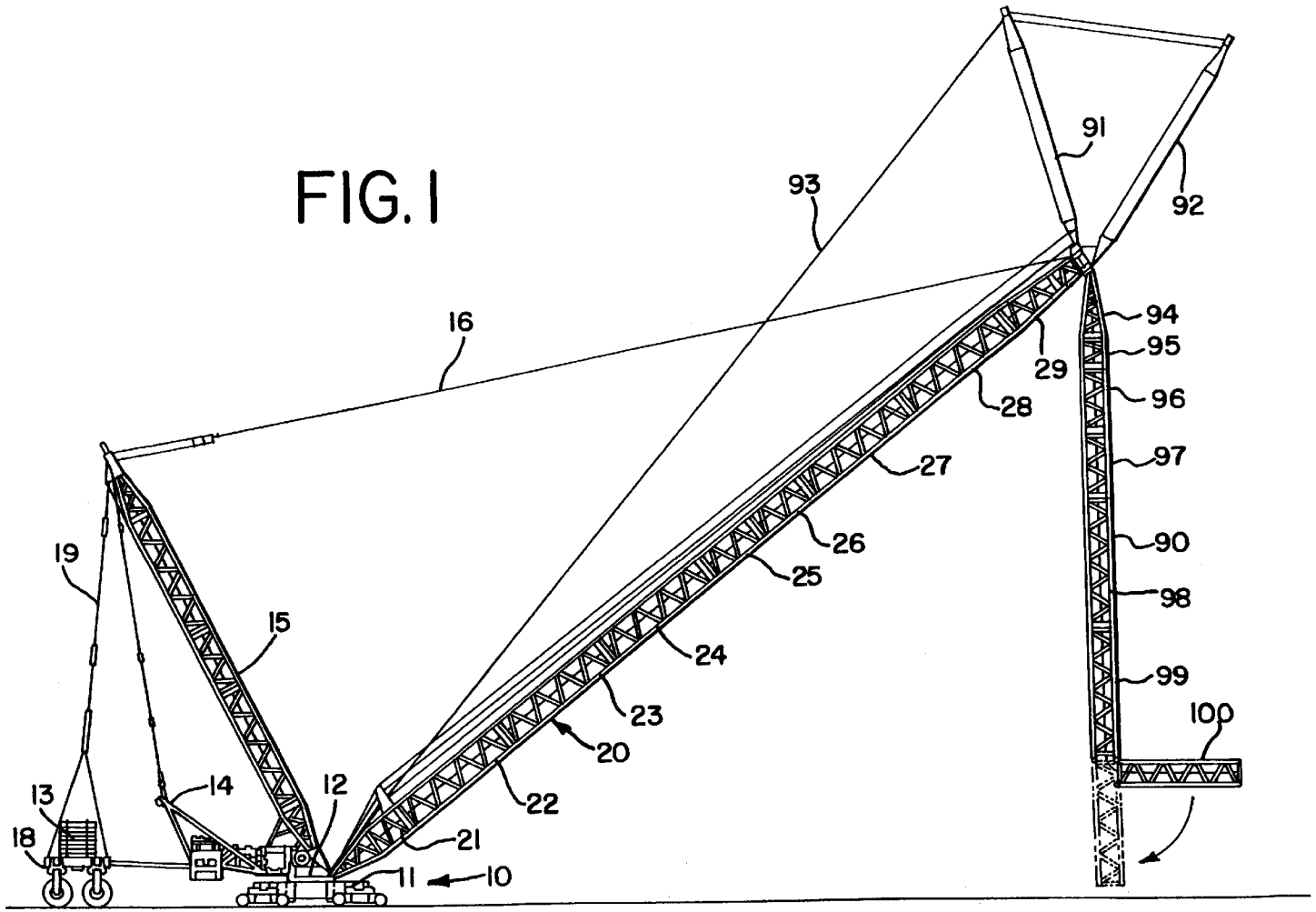
FIG. 1 is a side view of a typical crane with a sectional main boom and luffing jib boom to which the present invention may be applied.

The typical crane 10, as shown in FIG. 1, is comprised of upper works 12 rotatably mounted on lower works 11 which, as shown, may include self propelled crawler tracks. The upper works 12 typically has a counterweight 13 attached thereto. In the crane embodiment depicted, the counterweight 13 is supported on a separate counterweight trailer 18. The upper works 12 also supports a back hitch 14 and mast or gantry 15, as well as a pivotally mounted boom 20. A winch with a load hoist line wound thereon (not shown) is also mounted on the upper works. Live rigging and a pendant 16 connects the top of the boom 20 to the gantry 15 and is used to adjust the boom angle. A pendant 19 connects the top of the gantry is to the counterweight 13.

The crane 10 as depicted also includes a luffing jib 90 with superstructures 91 and 92 and control lines 93 as is typically used to control the angle of the luffing jib 90 secured in pivotal relationship to the top end of boom 20.

In conventional cranes, the boom 20 is made of several sectional members, including a boom butt 21, boom insert sections 22, 23, 24, 25, 26, 27 and 28, which may vary in number and be of different lengths, and a boom top 29. The sectional boom members 21–28 typically are comprised of multiple chords. The luffing jib boom 90 is likewise made of a luffing jib boom butt 94 and boom insert sections 95, 96, 97, 98, 99 and 100, which like boom insert sections 22–28 may vary in number and be of different lengths. A luffing jib top end (not shown) is added to the end of the last insert.

Figures 2, 3, 3A, 3B, 4:
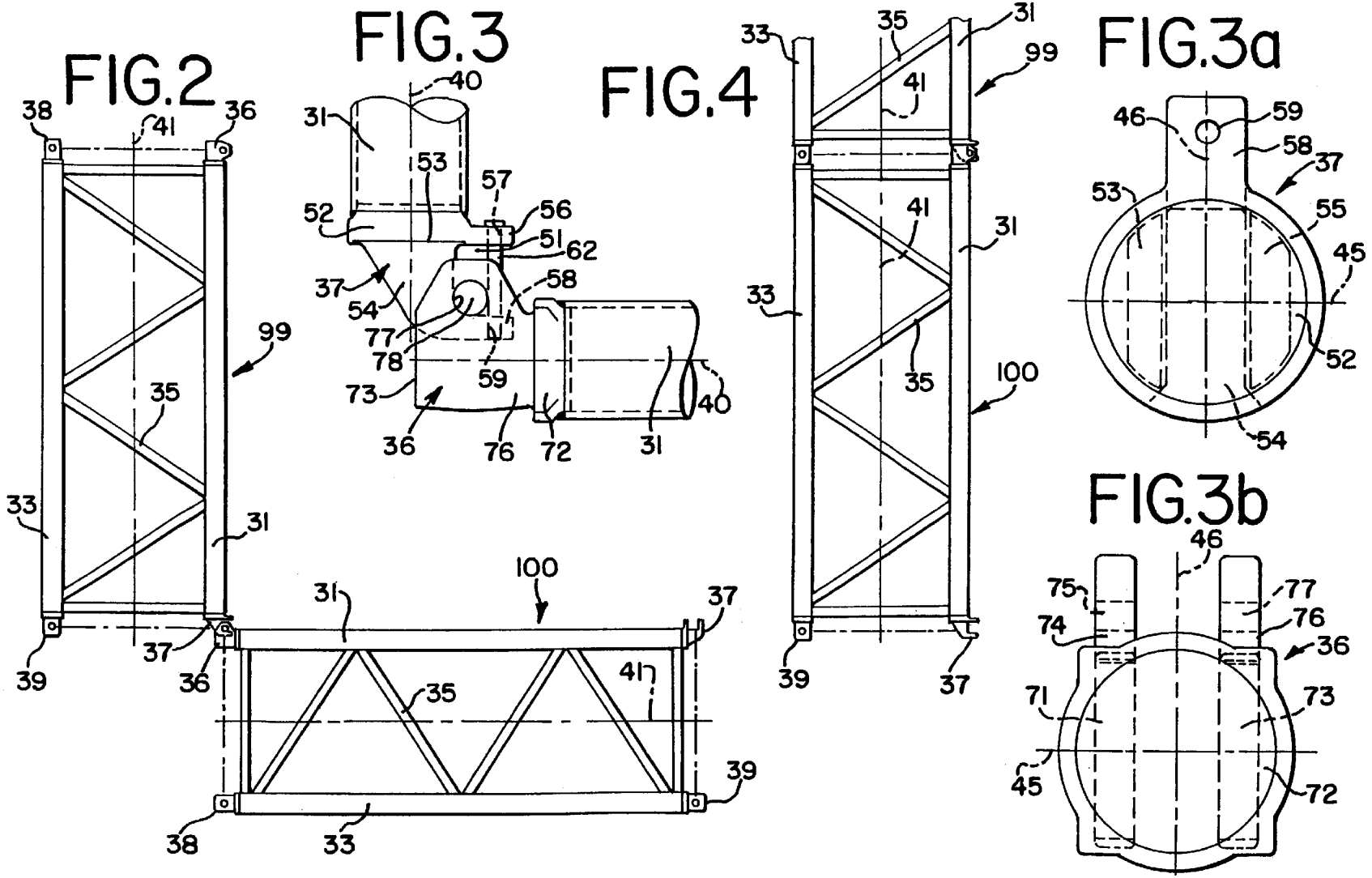
FIG. 2 is a side elevational view of a preferred embodiment of a rotatable connection system of the present invention showing two boom sections during perpendicular engagement of the sections.
FIG. 3 is an enlarged, partially sectional, side elevational view of one of the top chord connections depicted in FIG. 2.
FIG. 3*a* is an end view of the male connector shown in FIG. 3 without the retaining pin.
FIG. 3*b* is an end view of the female connector shown in FIG. 3 without the coupling pin.
FIG. 4 is a side elevational view of the boom sections of FIG. 2 in an aligned vertical relationship.

In the embodiment shown in FIG. 2, each luffing jib boom section 99 and 100 has a rectangular cross section with a chord at each corner. The sections 99 and 100 each have a longitudinal axis 41, as well as first and second ends. There are two top chords 31 and two bottom chords 33 (only one of each of which can be seen in the side view) interconnected by intermediate lacing or lattice elements 35. In the embodiment shown, the chord members are made of steel with circular cross section. Each chord member has a vertical neutral axis and a horizontal neutral axis. In the case of chords with circular cross sections, the horizontal and vertical neutral axes intersect at a line 40 which is at the centerline of the chord (FIG. 3). Compressive loads applied at the intersection 40 of the vertical and horizontal neutral axes of a chord, or symmetrically about the horizontal and vertical neutral axes, will not induce bending moments within the chord.

The preferred rotatable connectors are described as being provided on the top chords 31 of a boom section. Connectors for bottom chords 33 are also disclosed. Mating connectors are attached to abutting ends of the chords of the sectional boom members. The mating connectors generally have a male and female relationship. Thus, there are two top chord female connectors 36 and two bottom chord female connectors 38 on each boom section, generally but not necessarily on the same end of the boom section, as well as two top chord male connectors 37 and two bottom chord male connectors 39 on opposite ends of the boom section from the respective top and bottom chord female connectors. Thus, when two boom sections, such as sections 99 and 100, are brought together for assembly, the two top chord female connectors 36 of section 100 mate with the top chord male connectors 37 of section 99, and the bottom chord female connectors 38 of section 100 mate with the bottom chord male connectors 39 of section 99. Since the connectors on all of the sections 23–28 of main boom 20 and sections 95–100 of luffing jib boom 90 are identical, the foregoing reference numbers 31, 33, 35, 36, 37, 38, 39 and 40 are used in all of the figures, whether showing main boom sections or luffing jib boom sections.

FIGS. 2–4 are used to depict the procedure in which a second boom section is added to a first boom section that is part of a vertically hanging boom, and therefore luffing jib boom sections 99 and 100 are depicted. FIGS. 5–9 are used to depict the procedure in which a second boom section is added to a horizontally extending first boom section. While this procedure can be used for connecting luffing jib boom sections, it is depicted using main boom sections 23 and 24. Of course, there may be times when it would be desirable to connect main boom sections using a rotational procedure depicted in FIGS. 2–4.

As best shown in FIGS. 3 and 3*a*, the male connector 37 has a base 52 and a protrusion 54. The protrusion 54 extends perpendicularly from the base 52, in a direction generally parallel to the longitudinal axis 41 of the crane boom section 99. Extensions 56 and 58 extend respectively from the base 52 and the end of protrusion 54 in a direction generally perpendicular to, and directed outwardly of, the longitudinal axis 41. Each extension 56 and 58 has an aperture 57, 59, respectively. The apertures 57 and 59 are in line with one another on a line that is generally parallel to the longitudinal axis 41. The extensions 56 and 58 cooperate with the protrusion 54 to define a socket 51. As shown in FIG. 3*a*, there are two shoulders with machined abutment surfaces 53 and 55 located on the base 52, one on each side of protrusion 54.

As best seen in FIG. 3*b*, the female connector 36 also has a base 72 and has two protrusions 74 and 76 extending generally perpendicularly from the base 72. The protrusions 74 and 76 are spaced apart at a distance greater than the width of the protrusion 54 on male connector 37 such that the male protrusion 54 fits between the female protrusions 74 and 76. The female connector also comprises a coupler sized and shaped to fit within socket 51. The coupler will connect to at least one of the protrusions 74 and 76 and extend toward the other protrusion. In the preferred embodiment depicted, each of the protrusions 74 and 76 have a round hole 75 and 76, respectively, through the protrusion, and the coupler comprises a cylindrically shaped coupling pin 78 extending through the holes 75 and 77. The coupling pin 78 thus spans between the female protrusions and is preferably free to rotate within the holes. Preferably, the coupling pin 78 extends through the holes and cotter pins (not shown) or the like are used to capture the pin 78 to prevent longitudinal movement or dislodgement of the pin. The protrusions 74 and 76 have abutment surfaces machined onto their ends 71 and 73, respectively.

The length of protrusion 54 on the male connector is less than the length of the protrusions 74 and 76 on the female coupler. As a result, the abutment surfaces 71 and 73 on the ends of female protrusions rest against the machined abutment surfaces 55 and 53, respectively, when the male and female connectors are placed in a mating position. Thus, when the male and female connectors are fully engaged, compressive loads on the boom are transferred across the abutment surfaces 71, 73 and 55, 53.

When the connectors 36 and 37 are coupled, the coupling pin 78 fits within socket 51. Preferably, the inside corner of socket 51 is machined to the radius of the cylindrical coupling pin 78. As seen in FIG. 3, once the connectors are coupled, a retainer is connected so as to extend between and be secured to the extensions 56 and 58 of the male connector 37 to enclose the coupling pin 78 within the socket 51 and prevent the connectors from uncoupling. Preferably, the retainer is a retaining pin 62 which extends through apertures 57 and 59 in the extensions 56 and 58.

As shown in FIGS. 2 and 4, the connectors of the present invention allow sectional boom members to be connected and then rotate through a full 90° angle. In FIG. 2, a first boom section 99 is suspended vertically. A second boom section 100, suspended horizontally, such as by an assist crane (not shown), is brought into place where the female connectors 36 of section 100 can be coupled to male connectors 37 of section 99. Even though the longitudinal axes 41 of the two boom sections are perpendicular to one another, the coupling pins 78 on the female connector 36 can still be placed in the sockets 51 of the male connectors 38. After retaining pins 62 are in place, the assist crane can let the free end of section 100 swing downwardly and underneath the first section 99. The boom sections rotate about the coupling pins 78 until the longitudinal axes 41 of each boom section are brought into an aligned relationship (FIG. 4). At this point, the abutment surfaces 53, 55, 71 and 73 on the male and female connectors are engaged, and the connectors on the bottom chords 33 are pinned together, as described more fully hereafter.

Figures 5, 6, 7, 8, 9:
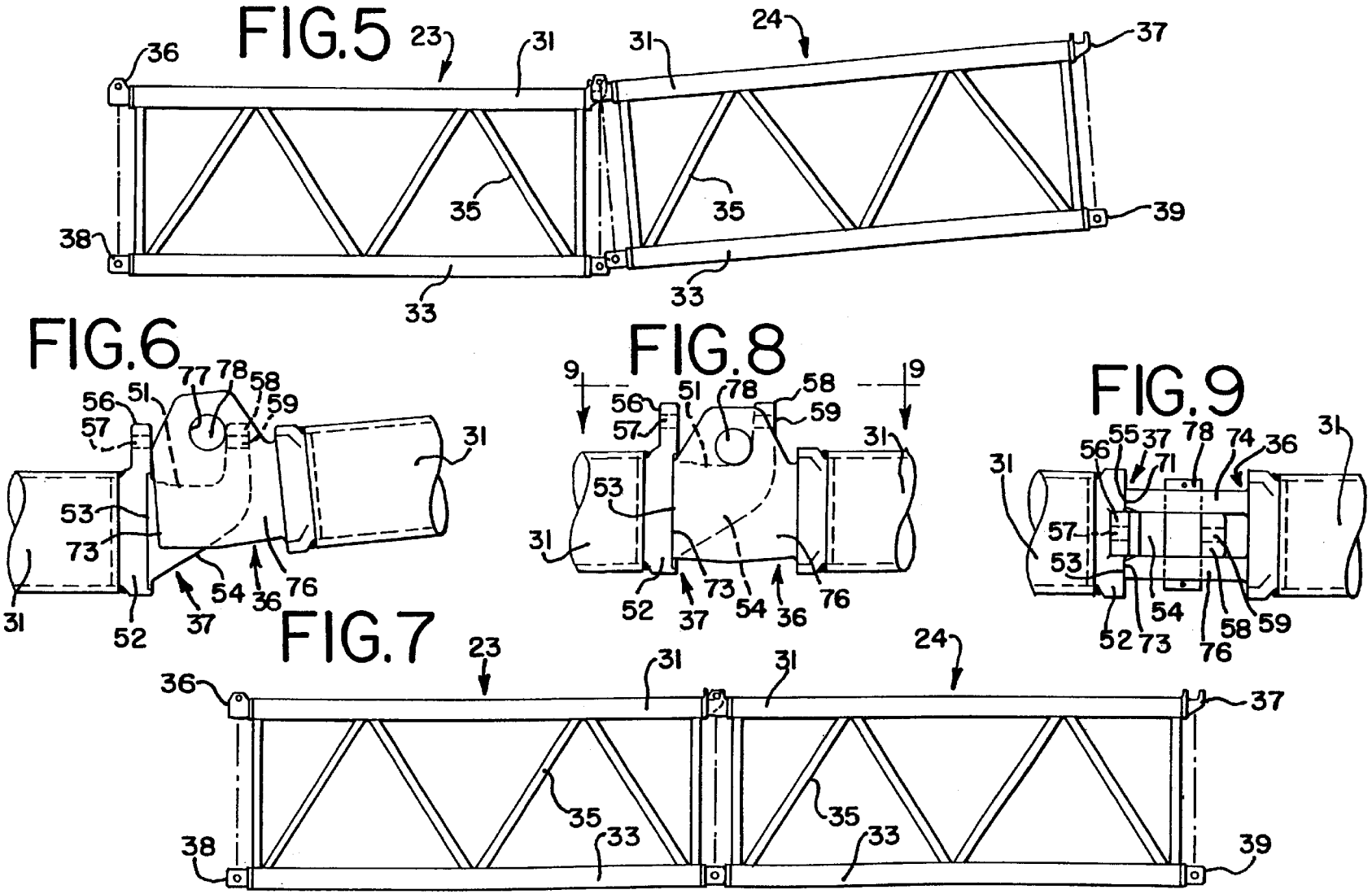
FIG. 5 is a side elevational view, similar to FIG. 2, but with two boom sections in a near horizontal engagement.
FIG. 6 is an enlarged, partly sectional side elevational view, similar to FIG. 3, showing a top chord connection of the boom sections of FIG. 5.
FIG. 7 is a side elevational view of the boom sections of FIG. 5 in an aligned horizontal relationship.
FIG. 8 is an enlarged, partly sectional view, similar to FIG. 6, showing the top chord connection when the boom sections are in an aligned, operational position.
FIG. 9 is a top plan view, partially in section, of the connectors taken along line 9—9 of FIG. 8.

FIGS. 5–9 show the procedure for connecting boom sections of the preferred embodiment of the invention together when the connection is made to a boom section in a horizontal position. As shown in FIG. 5, a first boom section 23 is horizontal, perhaps supported by blocking on the ground. The second boom section 24 is brought in at a nearly horizontal angle, such that the longitudinal axes of the two boom sections 23 and 24 are nearly parallel. Once again, the coupling pin 78 fits within socket 51 when the first and second boom sections are initially coupled together (FIG. 6).

The shape of the socket and coupling pin 78 cooperate to cause the longitudinal axes of the two boom sections to align with one another as the male and female connectors 37 and 36 are completely engaged (FIGS. 7, 8 and 9).

Figure 10:
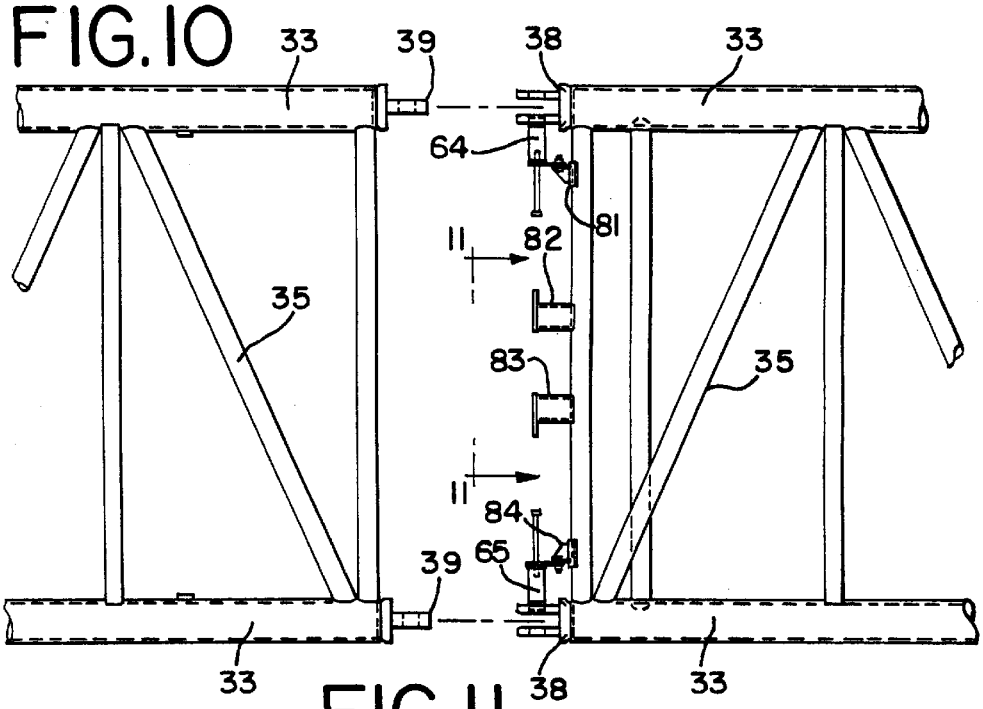
FIG. 10 is a bottom plan view of the preferred boom sections of FIG. 2 showing the bottom connectors being brought into position.

FIG. 10 shows the engagement of the connectors on the bottom chords 33, which as noted above are pinned together after the male and female connectors 37 and 36 on the top chords 31 are fully engaged. The bottom chords each have connectors which are more conventional in nature. On one end of each bottom chord, the connector 39 has one protrusion and on the other end, the connector 38 has two protrusions. When two boom sections are brought into connecting alignment, the single protrusion on the connector 39 on a second end of the first boom section will fit in between the two protrusions on the connector 38 on the first end of the second boom section. Each of the protrusions on connectors 38 and 39 have aperture through them. Two bottom connection pins 64 and 65 are inserted through the apertures to secure the second ends of the bottom chord members 33 on the first boom section to the first ends of the bottom chord members 33 on the second boom section.

Figure 11:
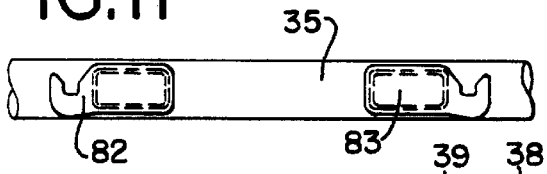
FIG. 11 is an end view taken along line 11—11 of FIG. 10.
Figure 12:
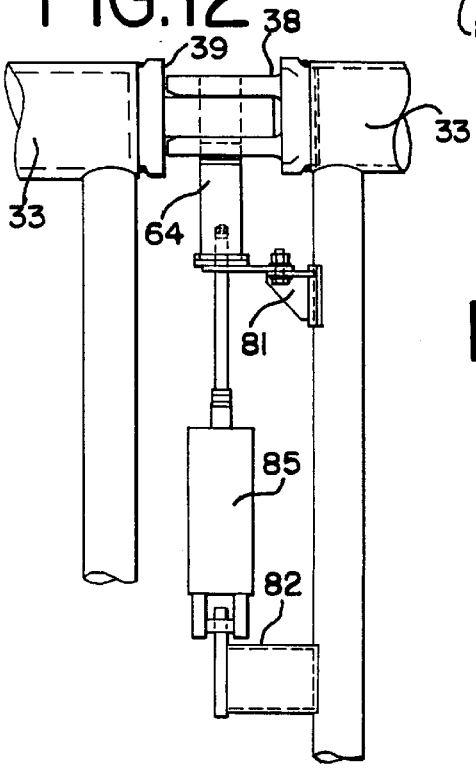
FIG. 12 is an enlarged plan view of the boom sections of FIG. 10 with the connectors in an engaged relationship, also showing a hydraulic cylinder used to force a bottom connection pin into place.
Figure 13:
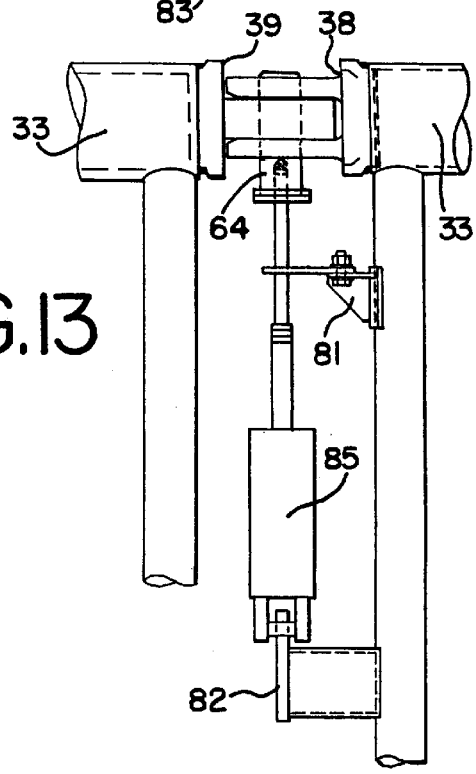
FIG. 13 is an enlarged plan view similar to FIG. 12 with the hydraulic cylinder extended and the bottom connection pin in place.

In the preferred embodiment of the invention, the boom section includes brackets 81, 82, 83 and 84 used to mount a hydraulic cylinder 85 (FIGS. 11–13) which in turn is used to insert and remove bottom connection pins 64 and 65. Preferably, brackets 81 and 84 hold one end of pins 64 and 65, respectively, in place for insertion with the other end of pins 64 and 65 being held in the aperture through the protrusion on connector 38 closest to the center of the boom section. A hand-held hydraulic cylinder 85 is fitted to either bracket 82 or 83, depending on which pin is to be inserted. As shown in FIG. 12, the piston end of cylinder 85 is held in bracket 82 and the rod end of cylinder 85 connects to the head of pin 64. Extension of the cylinder 85 drives the pin 64 through the apertures in the protrusions on the aligned connectors 38 and 39 (FIG. 13). The cylinder 85 can also be used to retract the pins 64 and 65.

As noted previously, it is preferable to have the abutment surfaces on connectors symmetrical about the horizontal and vertical neutral axes of the chord to which the connectors are attached. As shown in FIG. 3*a* the abutment surfaces 53 and 54 are symmetrical about the horizontal neutral axis 45 and the vertical neutral axis 46 of chord 31 to which male connector 37 is attached. Likewise, as shown in FIG. 3*b*, the abutment surfaces 71 and 73 are symmetrical about the horizontal and vertical neutral axes 45 and 46 of the chord 31 to which female connector 36 is attached. In this manner, not only can the boom sections of the present invention be brought into contact while perpendicular to one another and rotated into an aligned position, but in use, the compressive forces are transferred through the connectors without causing a bending moment in the chord 31.

The connectors of the present invention also allow boom sections to be connected from a nearly parallel arrangement, adding to the versatility of the crane boom sections. The sections can thus be used to construct a main boom that is laid out in a horizontal fashion, or a luffing jib boom that is assembled in a hanging vertical position.

Besides the preferred embodiment of the invention depicted in the Figures, there are other embodiments contemplated. For example, instead of having a pin spanning between the female connector protrusions, lugs could be affixed to one or both of the inside faces of the protrusions. These lugs would fit in the socket 51 and be captured by the retaining pin 62. Other types of retainers, such as straps, could be secured between the extensions 56 and 58.

The socket and coupler could be exchanged between the male and female connectors. The male connector could have a coupler pin extending outwardly from both sides of a single protrusion and the female protrusions could each be shaped with a socket and retainer.

It should be appreciated that the apparatus of the present invention is capable of being incorporated in the form of a variety of embodiments, only a few of which have been illustrated and described above. The invention may be embodied in other forms without department from its spirit or essential characteristics. The described embodiments are to be considered in all respects only as illustrative and not restrictive, and the scope of the invention is therefore indicated by the appended claims rather than by the foregoing description. All changes which come within the meaning and range of equivalency of the claims are to be embraced within their scope.

What is claimed is:

1. A crane having a boom with a rotatable boom section connection system, the crane having an upper works rotatably mounted on a lower works, the upper works including a load hoist winch, the boom comprising:

a) at least a first and second boom section each with a longitudinal axis and a first and second end, the second end of the first section being coupled to the first end of the second section;

b) at least one male connector on the second end of the first section coupled to a female connector on the first end of the second section;

c) the male connector comprising a base and a protrusion, the base and protrusion each having an extension in a direction generally perpendicular to the longitudinal axis of said first boom section, the extensions and protrusion defining a socket;

d) the female connector comprising two protrusions spaced apart at a distance such that the protrusion of the male connector fits between the two protrusions, the female connector further comprising a coupler connected to at least one of the protrusions and extending toward the other protrusion and fitting within the socket of the male connector; and e) a retainer extending between and secured to the extensions of the male connector enclosing the coupler within the socket and preventing the male and female connectors from uncoupling.

2. The crane of claim 1 wherein the longitudinal axis of said first boom section is perpendicular to the longitudinal axis of said second boom section when the first and second boom sections are initially coupled together, but the boom sections are rotatable about the coupler so that the longitudinal axis of the first and second boom sections may be brought into an aligned relationship.

3. The crane of claim 1 wherein the longitudinal axis of the first boom section is nearly parallel to the longitudinal axis of the second boom section when the first and second boom sections are initially coupled together, and the shape and position of the socket and coupler cooperate to cause the longitudinal axis of the first and second boom sections to align with one another as the male and female connectors completely engage.

4. The crane of claim 1 wherein the each of the extensions of the male connector have an aperture therethrough, the apertures being a line with one another along a line generally parallel to the longitudinal axis of the first section and the retainer comprises a retaining pin extending through the aperatures.

5. The crane of claim 1 wherein the two protrusions on the female connector each comprise a round hole and the coupler comprises a coupling pin extending through the round holes.

6. The crane of claim 5 wherein the coupling pin is free to rotate within the holes of the female protrusions but is captured to prevent the pin from being dislodged longitudinally through the holes.

7. The crane of claim 1 wherein said boom comprises a main boom having a top end and a luffing jib boom secured in pivotal relationship to the top end of the main boom, and wherein the said first and second boom sections form part of said luffing jib boom.

8. The crane of claim 1 wherein the first and second boom sections each comprise four chords with intermediate lacing element therebetween, each of chords having first and second ends corresponding to the first and second ends of the boom sections.

9. The crane of claim 8 wherein two of said four chords comprise top chords and the other two of said four chords comprise bottom chords when the crane is in an operational mode.

10. The crane of claim 9 wherein the two top chords each have said male connectors on their second ends and said female connectors on their first ends.

11. The crane of claim 9 wherein the bottom chords each have connectors with one protrusion on their second end and two protrusion on their first end, each of the protrusions having an aperture therethrough, and two bottom connection pins are inserted through the apertures to secure the second ends of the bottom chord members on said first boom section to the first ends of the bottom chord members of said second boom section.

12. The crane of claim 11 further comprising brackets on the first end of the second boom section for mounting a hydraulic cylinder used to insert said bottom connection pins.

13. The crane of claim 1 wherein the base of the male connector comprises shoulders on at least two sides of the protrusion and said shoulders have abutment surfaces thereon, and the protrusions of the female connectors have abutment surfaces on the ends thereof in a mating position to the male connector abutment surfaces such that when the male and female connectors are fully engaged, compressive loads on the boom are transferred across said abutment surfaces.

14. The crane of claim 13 wherein the male and female connectors are positioned on the ends of chords making up the boom sections and the abutment surfaces are symmetric about both horizontal and vertical neutral axes of the chords to which the connectors are secured.

15. The crane of claim 14 wherein the coupler is spaced above the neutral axis of the chord to which the female connector is secured.

16. The crane of claim 13 wherein the abutment surfaces comprise machined surfaces on the connectors.

17. The crane of claim 1 wherein the coupler is cylindrical in shape and the socket comprises a machined surface having a radius in one corner thereof equal to the radius of the coupler.

18. A sectional boom member with a rotatable connection system comprising:

a) a boom section having a longitudinal axis, a first end and a second end, and each end having at least three connectors, the at least three connectors of said first end designed to mate with three connectors of a second end of an identical boom section;

b) a first of said at least three connectors on said second end comprising a male connector having a base and a protrusion, and shoulders on the base on at least two sides of said protrusion, the protrusion and base each having an extension in a direction generally perpendicular to the longitudinal axis, the extensions cooperating with the protrusion to define a socket, each of said extensions having an aperture therethrough, the apertures being in line with one another along a line generally parallel to the longitudinal axis;

c) a first of said at least three connectors on said first end comprising a female connector having two protrusions spaced apart at a distance greater than the width of the protrusion on the male connector and a coupling pin spanning between the female protrusions, the coupling pin having a size and being shaped to fit within the socket of the male connector;

d) a retaining pin fitting through the aligned apertures of the male connector for retaining a coupling pin of a female connector of an identical boom section within the socket, thereby preventing the male and female connectors from becoming uncoupled; and e) the ends of the protrusion on the female connectors having abutment surfaces that are shaped to contact the shoulders of a mating male connector of an identical boom section to transfer compressive loads between the boom sections.

19. The sectional boom member of claim 18 wherein each of the protrusions on the female connector has a round hole therethrough and said coupling pin comprises a cylindrical pin extending through said holes and being secured so as to be rotatable within the holes but captured to prevent longitudinal movement of the coupling pin.

20. The sectional boom member of claim 18 wherein the boom section comprises four chords with intermediate lacing elements therebetween; each chord having a connector on each of its first and second ends.

21. The sectional boom member of claim 20 wherein two of the chords have said male connectors on their second end and said female connectors on their first end.

22. The sectional boom member of claim 21 wherein the other two of said four chords each have a second end with a connector having one protrusion thereon, the protrusion having an aperture therethrough, and a first end with a connector having two protrusions thereon, each of the protrusions having an aperture therethrough, the protrusions on the connector on said first end being spaced apart a distance greater than the width of the protrusion on the connector on said second end; and the three apertures being aligned such that a pin may fit through the aperture of a connector on a second end of one chord and through the two apertures of a connector on a first end of a chord on an identical boom section.

23. The sectional boom member of claim 18 wherein the length of the protrusion on the male connector is less than the length of the protrusions on the female connector.

24. The sectional boom member of claim 18 wherein the male and female connectors are shaped such that a female connector of an identical second boom section can be coupled to a male connector of a first boom section and said retaining pin inserted through the aligned apertures of the male connector when the longitudinal axis of said second identical boom section is perpendicular to the longitudinal axis of the first boom section.

* * * * *